US006881054B2

(12) United States Patent
Levi et al.

(10) Patent No.: US 6,881,054 B2
(45) Date of Patent: Apr. 19, 2005

(54) COMBINATION RADIANT/CONVECTION GAS COOKING APPLIANCE

(75) Inventors: David E. Levi, Ringgold, GA (US); Mark A. Pickering, Cleveland, TN (US); Lloyd A. Smith, Jr., Charleston, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/659,321

(22) Filed: Sep. 11, 2003

(65) Prior Publication Data

US 2005/0056267 A1 Mar. 17, 2005

(51) Int. Cl.[7] ..... F24C 1/00
(52) U.S. Cl. ..... 431/21 A; 126/21 R
(58) Field of Search ..... 126/21 A, 21 R, 126/273 R

(56) References Cited

U.S. PATENT DOCUMENTS 3,624,742 A * 11/1971 Hurko et al. ..... 126/39 D
4,211,909 A * 7/1980 Yoshida et al. ..... 219/683
4,375,213 A * 3/1983 Kemp et al. ..... 126/21 A
4,480,628 A * 11/1984 Simpson ..... 126/21 A
4,598,691 A * 7/1986 Herrelko et al. ..... 126/41 R
4,639,213 A * 1/1987 Simpson ..... 431/326
4,930,489 A * 6/1990 McFadden ..... 126/41 R
4,951,648 A 8/1990 Shukla et al.
5,080,087 A * 1/1992 McFadden et al. ..... 126/21 A
5,492,055 A 2/1996 Nevin et al.
5,620,623 A 4/1997 Baker
5,726,423 A 3/1998 Westerberg et al.
6,114,666 A * 9/2000 Best ..... 219/411
6,376,817 B1 4/2002 McFadden et al.

FOREIGN PATENT DOCUMENTS

WO WO 88/01719 3/1988

OTHER PUBLICATIONS

Gas Convection Burner System for Wayne Combustion Systems/Advertisement (2 pages).

* cited by examiner

*Primary Examiner*—Alfred Basichas
(74) *Attorney, Agent, or Firm*—Diederiks & Whitelaw, PLC

(57) ABSTRACT

A gas cooking appliance includes a combination radiant/convection cooking system mounted below a bottom wall portion of an oven cavity. The combination cooking system includes a gas burner in the form of a ring element having a central portion within which is positioned a convection fan. In addition to the convection fan, a forced air combustion fan supplies a combustion airflow to the gas burner. The oven preferably includes a glass panel arranged in a bottom wall portion of the oven cavity, above the gas burner. Arranged about the central opening are a plurality of vented openings for introducing the convective airflow into the oven cavity. The glass panel provides both a conductive heat surface transmitting at least a portion of the radiate heat energy into the oven cavity and a viewing surface allowing a consumer to view the operation of the gas burner.

22 Claims, 2 Drawing Sheets

COMBINATION RADIANT/CONVECTION GAS COOKING APPLIANCE

BACKGROUND OF THE INVENTION

1. Field of the Invention

The present invention pertains to the art of cooking appliances and, more particularly, a gas cooking appliance including a combination radiant/convection cooking system employing a gas burner located below a glass panel arranged along a bottom wall of an oven cavity.

2. Discussion of the Prior Art

In general, combining convection and radiant cooking is well known in the art of gas cooking appliances. In typical arrangements, a convection fan or blower is mounted on a top or rear wall of an oven cavity, while a gas burner is mounted along a bottom wall. With this arrangement, the gas burner radiates heat into the oven cavity while, at the same time, heats an airflow directed into the oven cavity by the convection blower.

Using this construction, in addition to ductwork required for combustion, cooling and exhaust air associated with the gas burner, additional ductwork is needed to carry the heated airflow from the gas burner to and from the convection blower. Obviously, this additional ductwork adds to the overall cost and complexity of the appliance, while also occupying space potentially available for other advantageous features. Furthermore, by transporting heated air through lengthy ducting, the efficiency of the appliance is reduced as a result of heat lost to the ducting and the surroundings. Finally, the need to draw the air from the burner up and into the oven cavity through the ducting increases the power requirement of the convection blower.

Based on the above, there exists a need in the art for a cooking appliance which positions the gas burner and blower assembly in close proximity to each other. Moreover, there exists a need in the art for a cooking appliance in which a gas burner is mounted in a protected region of an oven cavity, while still enabling the consumer to view the burner in operation.

SUMMARY OF THE INVENTION

The present invention is directed to a combination radiant/convection bake gas cooking appliance including a cabinet within which is arranged an oven cavity. Specifically, the appliance includes a combination radiant/convection cooking system having a gas burner and a convection fan assembly arranged below a bottom wall of the oven cavity. More specifically, the gas burner constitutes a ring burner assembly having a central portion within which is positioned a convection fan or blower.

In a preferred embodiment, the cooking system is positioned below a central opening arranged on the bottom wall of the oven cavity. More specifically, arranged about the central opening are a plurality of convection air vents adapted to direct a convective airflow from the cooking system into the oven cavity. In the most preferred embodiment, a glass panel, preferably CERAN glass, is positioned across the central opening. In this preferred embodiment, the glass panel transmits at least a portion of the radiant heat energy from the gas burner to the oven cavity, while allowing a consumer to view the gas burner in operation. In a more preferred embodiment, the convection cooking system, in addition to the convection fan, includes a forced air combustion fan adapted to supply a forced combustion airflow to the gas burner. With this arrangement, the efficiency of the gas cooking system increased.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
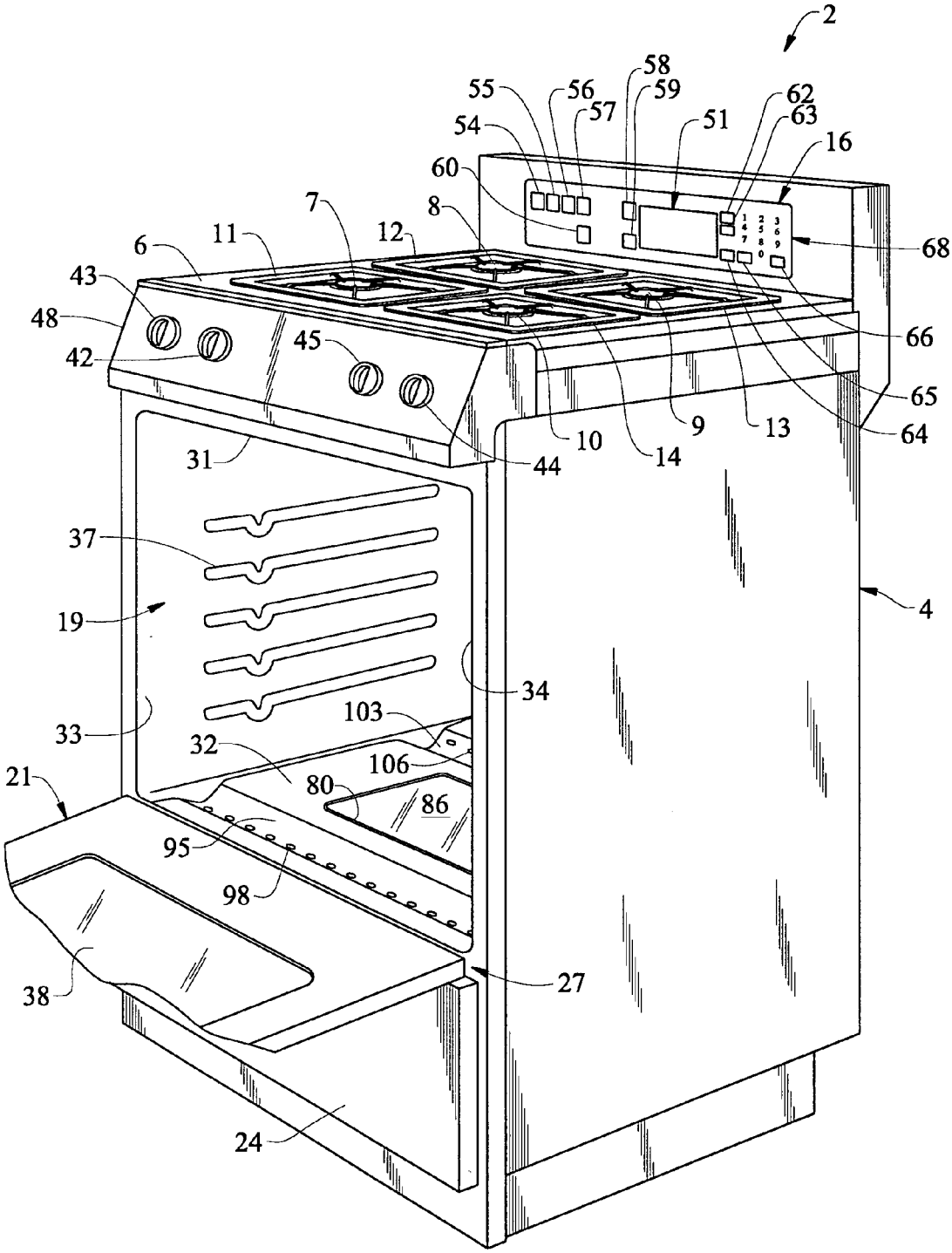
FIG. 1 is a perspective view of a range incorporating a combination radiant/convection gas cooking system constructed in accordance with the present invention.

With initial reference to FIG. 1, a cooking appliance 2 taking the form of a range includes a cabinet shell 4 provided with a cooktop 6. As illustrated, cooktop 6 is provided with a plurality of gas heating elements 7–10 having a corresponding plurality of gas burner grates 11–14. At this point, it should be noted that, although appliance 2 is shown to constitute a free standing gas range, the invention is equally applicable to various other types of types of gas ovens, including slide-in ranges, wall ovens and the like.

In a manner known in the art, gas cooking appliance 2 includes a control panel 16, an interior oven cavity 19 having an associated door 21, and a lower drawer or bin 24. More specifically, drawer or bin 24 is adapted to be slid into and out of cabinet shell 4 in order to access an interior storage compartment (not shown) arranged therein. As illustrated, door 21 is adapted to pivot at a lower portion 27 to enable selective access to within oven cavity 19. In a manner also known in the art, door 21 is provided with a transparent zone 38 for viewing oven cavity 19 while door 21 is closed. In the embodiment shown, oven cavity 19 includes at least a top panel 31, a bottom panel 32, opposing side panels 33 and 34, and a rear panel 35 (see FIG. 2). Arranged on side panels 33 and 34 are a plurality of baking rack support elements or rails 37.

A plurality of control knobs 42–45 for use in selectively activating and deactivating heating elements 7–10 respectively, are arranged on a front face portion 48 of cabinet shell 4. The heating of oven cavity 19 is preferably electronically controlled, with control panel 16 including a display zone 51, as well as a set of control buttons 54–57, which enable a consumer to select a desired cooking operation, e.g., bake, convection bake, broil, or keep warm operations. In addition, an operational mode cancel button 58, a light activation button 59 and a self-clean button 60 are provided on one side of display zone 51. On the opposing side of display zone 51, there is provided a operating set button 62, a timer button 63, cook and stop time buttons 64 and 65, a clock button 66, and a number pad 68.

In general, the structure described above with respect to cooking appliance 2 is already known in the art and does not constitute part of the present invention. Therefore, this structure has only been described for the sake of completeness. Instead, the present invention is particularly directed to a combination radiant/convection heating system adapted to establish a heated cooking environment within oven cavity 19.

Figure 2:
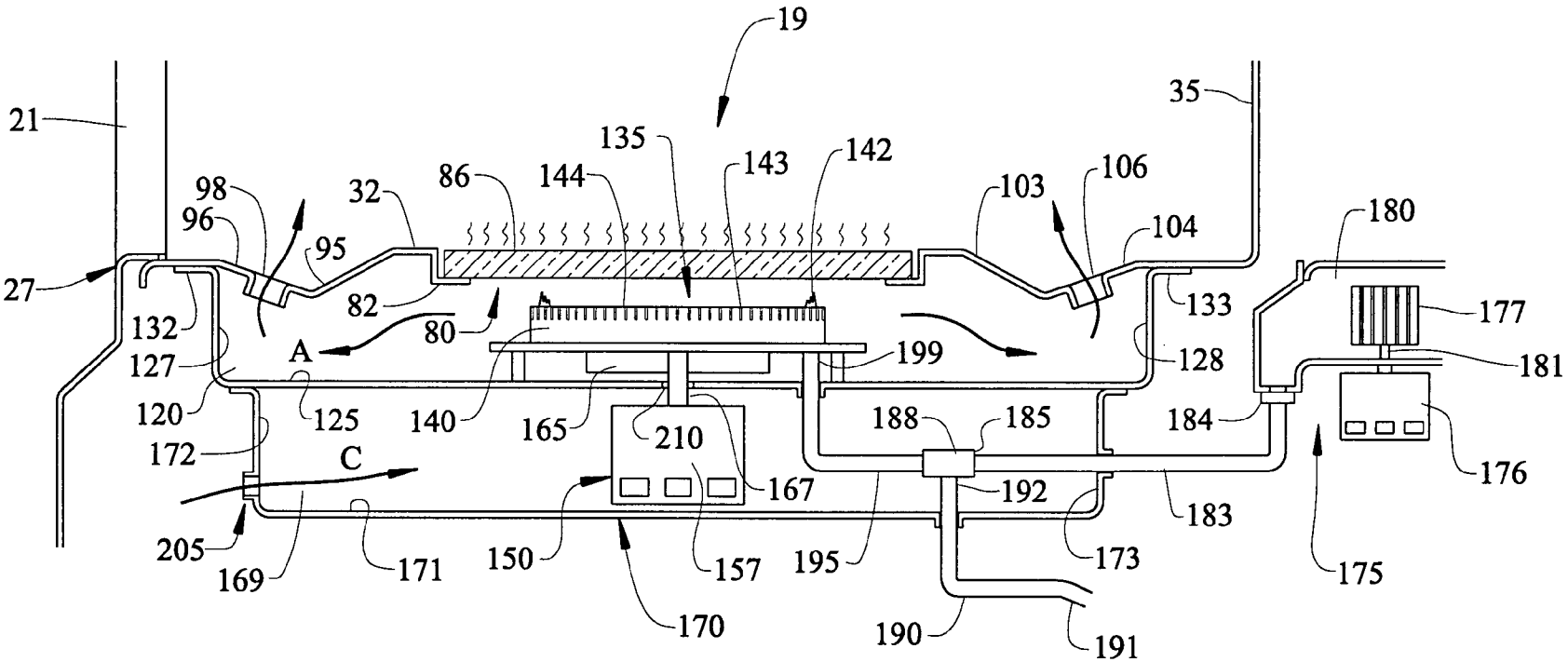
FIG. 2 is a partial cross-sectional view of the range of FIG. 1.

Referring to FIGS. 1 and 2, bottom panel 32 of oven cavity 19 includes a central opening 80. In the embodiment shown, central opening 80 is defined by an interior ledge portion 82 which supports a removable glass panel 86. More specifically, glass panel 86 is formed from a heat resistant, substantially transparent material, preferably a high temperature ceramic material such as CERAN. However, other materials having similar qualities are equally acceptable. Although the actual size of opening 80 could vary, the preferred embodiment provides for at least a 12 inch×12 inch (approximately 30.5 cm×30.5 cm) opening 80.

Along a front peripheral portion of central opening 80, bottom panel 32 includes a downward and forward sloping portion 95 that leads to an upward and forward sloping portion 96. With this construction, a front depression (not separately labeled) is defined forward of central opening 80. Arranged in this front depression, specifically along sloping portion 96, are a plurality of front vent openings generally indicated at 98. Similarly, extending along a rear peripheral portion of central opening 80 is a downward and rearward sloping portion 103 that leads to an upward and rearward sloping portion 104. In a manner similar to that illustrated for sloping portions 95 and 96, a rear depression (not separately labeled) is defined in bottom panel 32 and a plurality of rear vent openings 106 are provided in sloping portion 104.

As best shown in FIG. 2, a heating chamber 120, having at least a bottom wall portion 125 and opposing front and rear wall portions 127 and 128, is secured to bottom panel 32 of oven cavity 19. More specifically, heating chamber 120 is secured to bottom panel 32 through attachment flanges 132 and 133. As illustrated, positioned within heating chamber 120 is a gas heating system 135 which, when activated, generates heat to be delivered into oven cavity 19. In the embodiment shown, heating system 135 includes a gas burner 140 constituted by a ring-type burner having an outer peripheral portion 142, about which extends a plurality of gas outlet vents 143, and an open central portion 144.

Heating system 135 of cooking appliance 2 also includes a convection fan assembly 150 which can be activated to perform a portion of an overall cooking process. As shown, convection fan assembly 150 includes a convection fan motor 157 operatively connected to a convection fan or blower 165 through a drive shaft 167. Fan motor 157 is positioned within an air plenum 169 defined by a basin 170 having a bottom portion 171 and opposing side portions 172 and 173 which are secured to bottom wall portion 125. Of particular note is the positioning of fan 165 within central portion 144 of ring-type gas burner 140.

In the most preferred form of the invention, convection cooking system 150 includes a separate forced air convection system generally indicated at 175. Forced air convection system 175 includes a forced air convection motor 176 operatively connected to a forced air convection fan or blower 177 arranged within a convection air box 180. Motor 176 includes a motor shaft 181 drivingly connected to blower 177. With this arrangement, forced air generated by convection system 175 travels to gas burner 140 through an air supply line 183. That is, air supply line 183 has a first end 184 interconnected to convection air box 180 and a second end 185 connected to a junction fitting 188. A gas supply line 190 has a first end 191 adapted to interconnect with a mains gas supply and a second end 192 interconnected with junction fitting 188. With this arrangement, forced air generated by convection system 175 and gas from the mains gas supply intermix and are thereafter delivered to gas burner 140 within a burner supply line 195 which extends from an outlet portion of junction fitting 188 to an inlet portion 199 of gas burner 140. One type of acceptable system is that supplied by WAYNE COMBUSTION SYSTEMS. However, other similarly designed systems would be acceptable.

Having described a preferred construction of cooking appliance 2, a preferred method of operation will now be described. Assuming a combination bake/convection cooking operation is selected through control panel 16, forced air convection system 175 supplies forced air to burner 140. Simultaneously, a valve (not shown) is opened allowing gas to flow from the mains supply through supply line 190 to gas burner 140. At this point, the gas/air mixture is ignited through either a pilot light (not shown) or an electronic ignitor (also not shown). Upon activation, gas burner 140 emits a flame which is visible through glass panel 86. As gas burner 140 continues to operate, the temperature of glass panel 86 and, by extension, the bottom panel 32 of oven cavity 19 begin to heat, thereby providing radiant heat energy to within oven cavity 18.

Concurrently, electrical energy is supplied to convection fan motor 157 to rotate fan 165 in order to establish convective air streams generally indicated at A. As fan 165 operates, an incoming airflow C is drawn into air intake plenum 169 through a plurality of inlet ports, one of which is illustrated at 205. Incoming airflow C is subsequently drawn into central portion 144 of gas burner 140 through an intake opening 210 arranged at least partially about motor drive shaft 167. With this arrangement, heat energy from gas burner 140 is transferred through a convective heat process to the incoming airflow C forming convective air streams A. As the heat energy transfers from gas burner 140 to air streams A, fan 165 drives heated air streams A from interior cavity 144 of gas burner 140 through front and rear vent openings 98 and 106 into oven cavity 19. In this manner, food items placed in oven cavity 19 will be subjected to a more uniform cooking environment capable of performing a cooking process in less time than conventional ovens.

Although described with reference to a preferred embodiment of the present invention, it should be readily apparent to one of ordinary skill in the art that various changes and/or modifications can be made to the invention without departing from the spirit thereof. For instance, while the convective air inlet vent openings are shown extending along front and rear portions of the glass panel, other arrangements, including having the vents extend entirely about or even through the glass panel, would be acceptable. In addition, while the glass panel is described as having a dimension of 12"×12" (30.5 cm×30.5 cm), an alternative arrangement would be to construct substantially the entire bottom panel of the oven cavity from glass. In addition to radiant and convection cooking, a microwave system could be added to further reduce the overall cook time. In general, the invention is only intended to be limited by the scope of the following claims.

We claim:

1. A gas cooking appliance employing a combination radiant/convection heating system comprising:

an oven cavity including top, bottom and opposing side portions, said bottom portion including a central opening;

a glass panel positioned in the central opening;

a plurality of air inlet vents opening into the oven cavity;

a gas burner positioned below the glass panel and defining a central zone, said gas burner being adapted to radiant heat through the glass panel into the oven cavity;

a combustion airflow fan assembly for delivering a forced combustion airflow to the gas burner; and a convection blower assembly including a fan located within the central zone, said convection blower assembly being adapted to generate a convective air flow which passes the gas burner and flows through the air inlet vents into the oven cavity, wherein the gas burner produces heat for both radiant and convective heating of the oven cavity, with said gas burner being visible, at least when activated, when looking into the oven cavity and through the glass panel.

2. A gas cooking appliance employing a combination radiant/convection heating system comprising:

an oven cavity including top, bottom and opposing side portions;

a plurality of air inlet vents opening into the oven cavity;

a gas burner positioned below the bottom portion and defining a central zone, said gas burner being adapted to radiant heat into the oven cavity;

a convection blower assembly including a fan located within the central zone, said convection blower assembly being adapted to generate a convective air flow which passes directly across the gas burner and flows through the air inlet vents into the oven cavity, wherein the gas burner produces heat for both radiant and convective heating of the oven cavity.

3. The gas cooking appliance according to claim 2, further comprising:

a central opening provided in the bottom portion of the oven cavity; and a glass panel positioned in the central opening, said gas burner being visible, at least when activated, when looking into the oven cavity and through the glass panel.

4. The gas cooking appliance according to claim 3, wherein the bottom portion is formed with a central ledge portion removably supporting the glass panel.

5. The gas cooking appliance according to claim 3, wherein the central opening is at least 12 inches (30.5 cm) square.

6. The gas cooking appliance according to claim 2, wherein the gas burner takes the form of a ring.

7. The gas cooking appliance according to claim 2, further comprising: a combustion airflow fan assembly for delivering a forced combustion airflow to the gas burner.

8. The gas cooking appliance according to claim 7, wherein the combustion airflow fan assembly is spaced rearward of the gas burner.

9. The gas cooking appliance according to claim 2, wherein the bottom portion of the oven cavity includes a peripheral edge portion, said plurality of air inlet vents being provided in and at least partially extending about the peripheral edge portion.

10. The gas cooking appliance according to claim 2, further comprising: a cooktop including a plurality of surface gas burner elements.

11. A gas cooking appliance employing a combination radiant/convection heating system comprising:

an oven cavity including top, bottom and opposing side portions, said bottom portion including a central opening;

a glass panel positioned in the central opening;

a plurality of air inlet vents opening into the oven cavity;

a gas burner positioned below the glass panel, said gas burner being adapted to radiate heat through the glass panel into the oven cavity; and a convection blower assembly including a fan adapted to generate a convective air flow which passes the gas burner and flows through the air inlet vents into the oven cavity, wherein the gas burner produces heat for both radiant and convective heating of the oven cavity, with said gas burner being visible, at least when activated, when looking into the oven cavity and through the glass panel.

12. The gas cooking appliance according to claim 11, wherein the bottom portion is formed with a central ledge portion removably supporting the glass panel.

13. The gas cooking appliance according to claim 11, wherein the bottom portion of the oven cavity includes a peripheral edge portion, said plurality of air inlet vents being provided in and at least partially extending about the peripheral edge portion.

14. The gas cooking appliance according to claim 11, wherein the gas burner takes the form of a ring having a central zone, said fan being located within the central zone.

15. The gas cooking appliance according to claim 11, further comprising: a combustion airflow fan assembly for delivering a forced combustion airflow to the gas burner.

16. The gas cooking appliance according to claim 15, wherein the combustion airflow fan assembly is spaced rearward of the gas burner.

17. The gas cooking appliance according to claim 11, wherein the central opening is at least 12 inches (30.5 cm) square.

18. The gas cooking appliance according to claim 11, further comprising: a cooktop including a plurality of surface gas burner elements.

19. A method of heating an oven cavity through both radiant and convection heating comprising:

activating a gas burner located below a glass panel provided across a bottom portion of the oven cavity to cause heat to be radiated through the glass panel and into the oven cavity;

operating a convection blower assembly positioned within a central portion of the gas burner to cause a convective air stream to flow across and be heated by heat produced by the gas burner; and directing the convective air stream through a plurality of air inlet vents arranged about the glass panel.

20. The method of claim 19, further comprising:

viewing operation of the gas burner by looking into the oven cavity and through the glass panel.

21. The method of claim 19, further comprising:

introducing the convective air stream upwardly and centrally into the oven cavity.

22. The method of claim 19, further comprising:

directing a forced combustion airflow to the gas burner.

* * * * *